United States Patent [19]

Rubin et al.

[11] 4,045,376

[45] Aug. 30, 1977

[54] SYNTHETIC TURBINE OILS

[75] Inventors: Isaac D. Rubin, Wappingers Falls, N.Y.; John W. Nebzydoski, Miami, Fla.

[73] Assignee: Texaco Inc., New York, N.Y.

[21] Appl. No.: 679,531

[22] Filed: Apr. 23, 1976

[51] Int. Cl.[2] ..... C10M 1/28

[52] U.S. Cl. ..... 252/56 S; 252/56 R

[58] Field of Search ..... 260/56 S, 56 R

[56] References Cited

U.S. PATENT DOCUMENTS

| | | | |
|---|---|---|---|
| 3,123,563 | 3/1964 | Verley | 252/56 S |
| 3,282,971 | 11/1966 | Metro et al. | 252/56 S |
| 3,304,260 | 2/1967 | Fields et al. | 252/56 R |
| 3,505,230 | 4/1970 | Thompson | 252/56 S |
| 3,510,425 | 5/1970 | Wilson | 252/56 R |
| 3,554,913 | 1/1971 | Gisser et al. | 252/56 S |
| 3,607,749 | 9/1971 | Forbes | 252/56 R |
| 3,694,382 | 9/1972 | Kleiman et al. | 252/56 S |
| 3,869,396 | 5/1975 | van de Kraats | 252/56 R |

*Primary Examiner*—Arthur P. Demers

*Attorney, Agent, or Firm*—Thomas H. Whaley; Carl G. Ries; Henry W. Archer

[57] ABSTRACT

Disclosed are synthetic lubricating oil compositions for turbine engines containing a major amount of aliphatic carboxylic acid esters having lubricating properties whose pour points are depressed by the incorporation of a synergistic mixture of minor amounts of at least one mineral oil with a methacrylic pour point depressant.

9 Claims, No Drawings

SYNTHETIC TURBINE OILS

BACKGROUND OF THE INVENTION

1. Field of the Invention

This invention is concerned with synthetic lubricating oil compositions for bus or truck turbine engines. More particularly, the invention relates to aliphatic esters formed by the reaction of a pentaerythritol and an organic acid having from 2 to 12 carbon atoms per molecule whose pour points have been depressed by blending therewith a synergistic mixture of at least one mineral oil and a methacrylate pour point depressant.

The above-mentioned esters are inexpensive and would adequately provide lubrication to turbine engines except for their high pour points. However, their pour points cannot be depressed if conventional depressants for mineral oils are used alone.

2. Description of the prior art

The prior art to which this invention relate is aware inter alia of the following U.S. Pat. Nos: 2,796,402; 2,796,403; 2,796,404; 3,412,028; 3,476,685; 3,321,402; and 3,779,919. The last mentioned discloses the esters of this invention but in combination with the amine salt of a substituted rhodanine which imparts thereto corrosion-inhibiting and load carrying properties under high thermal and oxidative stress.

SUMMARY OF THE INVENTION

The synthetic lubricating oil composition of the invention comprises a major amount of an aliphatic ester-base oil having lubricating properties formed by the reaction of a pentaerythritol or trimethylol propane and a mixture of hydrocarbyl carboxylic acids having 2 to 12 carbon atoms per molecule and containing from 2 to 35 weight percent of a mixture of a mineral oil of lubricating viscosity and a polymethacrylate pour point depressant. The compounded lubricating oils of this invention generally can be further improved by adding minor amounts of conventional corrosion inhibitors and other conventional property modifiers.

The base fluid of the lubricant of the invention is an ester-base fluid prepared from pentaerythritol or trimethylolpropane and organic acids. Polypentaerythritols, such as dipentaerythritol and tripentaerythritol, can also be employed in the reaction to prepare the base oil.

The organic acids which are used to form the ester-base fluid include the straight-chain and branched-chain aliphatic acids, cycloaliphatic acids and aromatic acids as well as mixtures of these acids. The acids employed have from about 2 to 12 carbon atoms per molecule. Examples of suitable specific acids are acetic, propionic, butyric, valeric, isovaleric, caproic, pelargonic, decanoic, cyclohexanoic, naphthenic, benzoic acid, phenylacetic, tertiarybutylacetic and 2-ethylhexanoic acid.

In general, the acids are reacted in proportions leading to a completely esterified pentaerythritol or trimethylolpropane with the preferred ester bases being the pentaerythritol esters.

The pour points of representative base oils given below in Table I.

TABLE I

POUR POINTS OF BASE OILS

| | Pour Points (° F) |
|---|---|
| DipentaerythritolEster of Nonanoic Acid | +60 |

TABLE I-continued

POUR POINTS OF BASE OILS

| | Pour Points (° F) |
|---|---|
| Pentaerythritol Ester oF Nonanoic Acid | +48 |
| Pentaerythritol Ester of Octanoic Acid | +20 |
| Pentaerythritol Ester of Heptanoic Acid | −25 |
| Dipentaerythritol Ester of Hexanoic Acid | +75 |

The mineral oil components of the compositions of the invention are lubricating oil having pour points ranging from −40° F to +35° F. The ranges of their other properties are:

| | |
|---|---|
| SpG 60/60° F | 0.871–0.931 |
| Gravity API | 20.5–31.0 |
| Flash COC° F | 250 min. |
| VIS SUS 100° F | 80–400 |
| VIS SUS 210° F | 30–75 |

Suitable mineral oils give the following test results:

| | A | B | C |
|---|---|---|---|
| SpG 60/60° F | 0.913–0.931 | 0.871–0.887 | 0.871–0.892 |
| Gravity API | 20.5–23.5 | 28.0–31.0 | 27.0–31.0 |
| Flash COC° F | 355 min. | 425 min. | 350 min. |
| VIS SUS 100° F | 300–324 | 325–350 | 97–105 |
| VIS SUS 210° F | 46.0–49.0 | 53.0–55.0 | 36.0–39.0 |
| Pour ° F | −20 mx. | 10 mx. | 25 mx. |
| Ash % | 0.003 max. | 0.003 max. | 0.003 max. |
| Neut. No. | 0.10 max. | 0.10 max. | 0.10 max. |

The mineral oil component is used in amounts ranging from the 2 to 35 weight percent of the lubricant composition.

The polymeric pour point depressants used in the present invention are methacrylate polymers used with or without a mineral oil diluent.

Methacrylate polymers are well known V.I. improvers and pour point depressants. These methacrylate polymers are usually copolymers of two or more esters of methacrylic acid and usually have a molecular weight between 5000 and 500,000. The polymethacrylate esters have the following general formula:

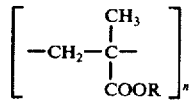

wherein R is an aliphatic radical preferably ranging from butyl to stearyl.

Copolymers which find particular use as V.I. improvers and pour points depressants are the following: a copolymer wherein R in the above formula comprises 20% lauryl, 40% octyl and 40% cetyl; a copolymer wherein R in the above formula is 50% stearyl and 50% lauryl; a copolymer wherein R in the above formula comprises 50% lauryl and 50% octyl.

Methacrylate polymers used as pour depressants are usually sold as concentrates comprising approximately 20 to 50% polymer in a carrier oil. The carrier oil can be either a mineral oil or an ester type oil. Typical ester-type oils are dioctyl sebacate, trimethylolpropane tripelargonate or $C_2$ to $C_{12}$ acid-derived mixed esters of pentaerythritol. An example of the last-named material is MW 14918 manufactured by Drew Chemical Corp., New York, N.Y.

Dispersant-type methacrylate copolymers, for examples Acryloid HF-866 manufactured by Rohm and Haas,incorporating nitrogen containing monomers such as vinyl pyrrolidone or dimethylaminoethylmethacrylate, are particularly effective, they are described in U.S. Pat. No. 3,142,664, 3,147,222, and 3,153,640. The methacrylate polymers can constitute between 0.005 to 5.00% of the composition of the final blend.

Typical pour depressants are described in Table II below:

TABLE II

IDENTIFICATION OF POUR DEPRESSANTS

"D" 33 wt. % of a polymer prepared from 75% Neodol 25 L synthetic lauryl methacrylate and 25% Alfol 1620 stearyl methacrylate and 67 wt. % mineral oil diluent.

"E" 25 wt. % of Acryloid HF-866 polymer and 75 wt. % of Drew Corporation 14918 synthetic ester base stock.

The invention is further illustrated but not limited by the Examples which follow.

In carrying out the procedures of the examples blends having the indicated compositions were prepared by blending samples having a total weight of 50 gm. with thorough mixing.

Then pour points were determined using ASTM Test D-97,"Pour Point of Petroleum Oils."

| EXAMPLE I | (° F) Pour |
|---|---|
| 100% Dipentaerythritol Ester of Nonanoic Acid | +60 |
| 80% $C_9$-DiPE ester/20% "B" | +50 |
| 79.0% $C_9$-Di PE ester/20% "B"/1%"D" | +15 |
| **EXAMPLE II** | |
| 100% Pentaerythritol Ester of Nonanoic Acid | +48 |
| 79.5% $C_9$ PE ester/0.5% "D"/20% "B" | +20 |
| 99.5% $C_9$ PE ester/0.5% "D" | +48 |
| **EXAMPLE III** | |
| 100% Pentaerythritol Ester of Octanoic Acid | +20 |
| 99.5% $C_8$ PE ester/0.5% "D" | +20 |
| 80.0% $C_8$ PE ester/20.0% "B" | 0 |
| 79.9% $C_8$ PE ester/20% "B"/0.1% "E" | −5 |
| 79.9% $C_8$ PE ester/20% "D"/0.1% "D" | −5 |
| 79.5% $C_8$ PE ester/20% "B"/0.5% "E" | −15 |
| **EXAMPLE 1V** | |
| 100% Pentaerythritol Ester of Octanoic Acid | +20 |
| 89.5% $C_8$ PE ester/10% "B"/0.5% "E" | 0 |
| 79.5% $C_8$ PE ester/20% "B"/0.5% "E" | −15 |
| 69.5% $C_8$ PE ester/30% "B"/0.5% "E" | −12 |
| **EXAMPLE V** | |
| 100% Pentaerythritol Ester of Heptanoic Acid | −25 |
| 80% $C_7$ PE ester/20% "B" | 0 |
| 75.8% $C_7$ PE ester/20% "B"/0.2% "E" | −65 |
| **EXAMPLE VI** | |
| 100% Dipentaerythritol Ester of Hexanoic Acid | +75 |
| 79.5% $C_6$ Di PE ester/20% "B"/0.5% "E" | +40 |
| **EXAMPLE VII** | |
| 100% Pentaerythritol Ester of Octanoic Acid | +20 |
| 80% $C_8$ PE ester/20% "C" | +10 |
| 79.5% $C_8$ PE ester/20% "C"/0.5% "D" | + 5 |
| **EXAMPLE VIII** | |
| 100% Pentaerythritol Ester of Octanoic Acid | +20 |
| 79.5% $C_8$ PE ester/20% "A"/0.5% "D" | 0 |

The foregoing Examples I, II, III, V demonstrate that a combination of mineral oil and pour depressant is more effective in depressing the pour point than either a mineral oil or pour depressant alone.

Example IV shows that the invention is operable at varied concentrations of mineral oil (10–30% "B").

Example VI gives further confirmation of the data presented in Examples I-V.

Examples VII and VIII show that the invention is operable with more than one mineral oil.

While the proportions of constituents given in the foregoing description give outstanding pour point depression with the given base oils, it will be appreciated that by following the teaching of the invention of the invention those skilled in the art will be able without undue experimentation to determine optimum composition ranges for other oils.

It is to be understood that the foregoing specific examples are presented by way of illustration and explanation only and that the invention is not limited by the details of such examples.

The foregoing is believed to so disclose the present invention that those skilled in the art to which it appertains can, by applying thereto current knowledge, readily modify if for various applications. Therefore, such modifications are intended to fall within the range of equivalence of the appended claims.

What is claimed is:

1. A synthetic lubricating oil composition comprising a major amount of an aliphatic ester base oil having lubricating properties and formed by the reaction of a pentaerythritol or trimethylolpropane and an organic acid having from about 2 to about 12 carbon atoms per molecule together with a pour point depressant amount of a mixture of a mineral oil having lubricating properties and a pour point ranging from −40° F to +35° F with a copolymer of two or more esters of methacrylic acid characterized by the formula:

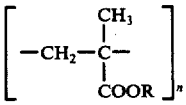

wherein R is a radical ranging from butyl to stearyl and n is an integer giving a molecular weight to said polymer ranging from 5000 to 500,000.

2. The composition of claim 1 containing from about 2 to 35 percent by weight of said mineral oil.

3. The composition of claim 1 containing from about 0.01 to 5.0 percent by weight of said polymer.

4. The composition of claim 1 wherein said ester is the dipentaerythritol ester of nonanoic acid.

5. The composition of claim 1 wherein said ester is the pentaerythritol ester of nonanoic acid.

6. The composition of claim 1 wherein said ester is the pentaerythritol ester of octanoic acid.

7. The composition of claim 1, wherein R in the above formula comprises 20 percent lauryl, 40 percent octyl and 40 percent cetyl.

8. The composition of claim 1, wherein R in said formula comprises 50 percent lauryl and 50 percent stearyl.

9. The composition of claim 1, wherein R in said formula comprises 50 percent lauryl and 50 percent octyl.

* * * * *